US011445886B2

(12) United States Patent
Schiele et al.

(10) Patent No.: US 11,445,886 B2
(45) Date of Patent: Sep. 20, 2022

(54) DISHWASHER WITH AN AUTOMATIC METERING DEVICE

(71) Applicants: BSH Hausgeräte GmbH, Munich (DE); Reckitt Benckiser (Brands) Limited, Slough (GB)

(72) Inventors: Alexander Schiele, Herbrechtingen (DE); Jakob Schultz, Dillingen (DE); Georg Walther, Munich (DE); Daniel Miller, Finningen (DE); Alberto Buogo, Lincoln (GB); Addie Muentzenberger, Heidelberg (DE); Anne-Katrin Späte, Heidelberg (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/269,292

(22) PCT Filed: Aug. 28, 2019

(86) PCT No.: PCT/EP2019/073013
§ 371 (c)(1),
(2) Date: Feb. 18, 2021

(87) PCT Pub. No.: WO2020/043798
PCT Pub. Date: Mar. 5, 2020

(65) Prior Publication Data

US 2021/0186297 A1 Jun. 24, 2021

(30) Foreign Application Priority Data

Aug. 29, 2019 (DE) ..... 10 2018 214 631.4

(51) Int. Cl.
*A47L 15/42* (2006.01)
*A47L 15/44* (2006.01)

(52) U.S. Cl.
CPC ..... *A47L 15/449* (2013.01); *A47L 15/4209* (2016.11); *A47L 15/4463* (2013.01)

(58) Field of Classification Search
None
See application file for complete search history.

(56) References Cited

U.S. PATENT DOCUMENTS

2010/0012161 A1* 1/2010 Classen ..... A47L 15/449 222/325

* cited by examiner

*Primary Examiner* — Levon J Shahinian
(74) *Attorney, Agent, or Firm* — Michael E. Tschupp; Andre Pallapies; Brandon G. Braun

(57) ABSTRACT

A dishwasher includes a washing chamber, and an automatic metering device configured automatically meter a plurality of metering quantities from a supply of cleaning agent in the form of a solid material into the washing chamber. The automatic metering device is held in a vibration-insulated manner.

13 Claims, 3 Drawing Sheets

DISHWASHER WITH AN AUTOMATIC METERING DEVICE

CROSS-REFERENCES TO RELATED APPLICATIONS

This application is the U.S. National Stage of International Application No. PCT/EP2019/073013, filed Aug. 28, 2019, which designated the United States and has been published as International Publication No. WO 2020/043798 A1 and which claims the priority of German Patent Application, Serial No. 10 2018 214 631.4, filed Aug. 29, 2018, pursuant to 35 U.S.C. 119(a)-(d).

BACKGROUND OF THE INVENTION

The present invention relates to a dishwasher with an automatic metering device.

Dishwashers having an automatic metering device are known, which automatic metering device enables a metering quantity to be dispensed into the washing liquor from a supply of cleaning agent in a program-controlled manner during operation of the dishwasher. Here, the supply comprises a quantity of cleaning agent which is sufficient to carry out several washing cycles with the dishwasher without the user having to top up the cleaning agent.

Devices of this kind are often arranged on the door of the dishwasher. The manner in which the automatic metering device is fastened to the door is problematic, since the dishwasher must have a fluid-tight treatment chamber. Moreover, mechanical vibrations such as structure-borne noise can be transmitted from the automatic metering device to the door, which can lead to undesirable operating noises.

BRIEF SUMMARY OF THE INVENTION

Against this background, one object of the present invention consists in proposing an improved dishwasher with an automatic metering device.

Accordingly, a dishwasher, in particular a household dishwasher, with a washing chamber and an automatic metering device is proposed. The automatic metering device is configured to automatically meter a plurality of metering quantities from a supply of cleaning agent provided as a solid material into the washing chamber. The automatic metering device is held in a vibration-insulated manner.

This dishwasher has the advantage that, on account of the vibration-insulated arrangement, mechanical vibrations from the automatic metering device are not transmitted or are transmitted only in attenuated form to the dishwasher, in particular to a dishwasher cavity of the dishwasher.

The washing chamber of the dishwasher is formed in particular by the dishwasher cavity and a door. The door can be opened in order to load the dishwasher cavity with items to be washed. Advantageously, the door is configured to close the dishwasher cavity in a fluid-tight manner.

The automatic metering device is configured to automatically meter a plurality of metering quantities of cleaning agent. This is understood in particular to mean that the automatic metering device meters a metering quantity of cleaning agent into the washing chamber when actuated, for example by a control device of the dishwasher. To this end, the automatic metering device comprises for example an extraction unit for extracting the metering quantity from the supply of cleaning agent. The supply is held in the dishwasher. The extracted metering quantity can then be dispensed directly into the washing chamber or alternatively via a device connected therebetween, in particular a metering channel, which is advantageously configured to separate the extraction unit and the washing chamber in a fluid-tight manner.

The automatic metering device is configured in particular to receive a supply of cleaning agent, wherein the supply can comprise a quantity of cleaning agent corresponding to a multiple of the metering quantity, for example 10 times, 20 times or also 50 times the metering quantity. The automatic metering device thus advantageously enables several washing cycles to be carried out with the dishwasher without a user having to top up the cleaning agent.

For example, the supply comprises up to 500 ml or 500 g of the cleaning agent and the metering quantity comprises 10 ml or 10 g of the cleaning agent. If the supply is initially filled to the maximum, 50 times the metering quantity can then be extracted from the supply before it is used up.

The metering quantity is for example determined such that it can be used to clean lightly soiled items to be washed. For more heavily soiled items to be washed, the total metering can be increased by metering the metering quantity multiple times. In embodiments of the automatic metering device, the metering quantity can be extremely small, for example one milligram, so that a total metering of cleaning agent can be adjusted very finely.

The cleaning agent is provided in particular as a solid material. The cleaning agent is advantageously pourable or free-flowing. The cleaning agent comprises in particular cleaning agent particles, which have for example a size of a few micrometers up to a few millimeters in diameter. For particle sizes of up to approximately 1 mm, reference is made for example to powder. For particle sizes in the region of approximately 5 mm, reference is made for example to pellets or tablets. In this context, pourable or also free-flowing is understood in particular to mean that the cleaning agent behaves in a similar manner to liquid under the influence of gravity.

The automatic metering device is held in a vibration-insulated manner. Vibration-insulated is also understood to mean in particular vibration-damped. The automatic metering device is deemed held in a vibration-insulated manner within the meaning of this application for example if a mechanical fastening of the automatic metering device transmits a mechanical vibration of the automatic metering device only to a reduced extent to a holding point of the dishwasher.

Mechanical vibrations preferably extend along solid components or objects. One can also say that the vibration propagates. One can also refer to structure-borne noise. In this context, the transmission properties of a component or object are in particular material-, geometry- and frequency-dependent. At an interface to air, such a mechanical vibration can also be converted into airborne noise or generate a sound wave in the air.

The automatic metering device is held by a vibration-insulating bracket, for example. Vibrations, in particular mechanical vibrations, are then transmitted only in attenuated form by the bracket from the automatic metering device to the dishwasher, for example to the dishwasher cavity in the event that the bracket is attached to the dishwasher cavity. Specifically in the event that the automatic metering device is fastened to the dishwasher cavity, the vibration-insulated holding is advantageous because the dishwasher cavity represents a resonance volume via which certain vibration frequencies can be amplified even further.

In particular, the vibration-insulating bracket damps a mechanical vibration of the automatic metering device in such a way that for example an amplitude of the mechanical vibration is reduced by at least 10%, preferably by at least 25%, more preferably by at least 50%, more preferably by at least 80% (and for example up to 99%) upon transmission via the bracket. Transmission is understood here to mean that the mechanical vibration propagates along the bracket and, from there, is coupled into the component of the dishwasher to which the bracket in turn is fastened. The bracket is fastened to the dishwasher cavity, for example.

The transmission of mechanical vibrations can be characterized for example by a transmission function. The transmission function is in particular frequency-dependent in relation to a vibration frequency.

The proposed dishwasher has the advantage that operating noises generated by the automatic metering device, for example during metering, do not reach the outside or do so only in attenuated form.

According to one embodiment of the dishwasher, a damping means is provided for holding the automatic metering device in a vibration-insulated manner.

A damping means is configured in particular to transmit mechanical vibrations only in attenuated form. The damping means comprises in particular gum, rubber, in particular vulcanized rubber, elastomers and foams. The damping means can also comprise shock absorbers and/or springs.

The damping means advantageously has a high loss factor, so that mechanical vibrations are dissipated in the damping means, in particular are converted into heat. Furthermore, the damping means advantageously has a low hardness or stiffness. A natural frequency of the damping means is then low, as a result of which the damping means has an insulating effect in relation to higher-frequency vibrations. One can also refer to a low-pass filter. The damping means can be characterized for example by means of the transmission function.

In particular, different damping means optimized for different frequency ranges can be provided, wherein vibrations advantageously pass through different damping means along each transmission path from the automatic metering device to the dishwasher so that the entire relevant frequency range is covered.

According to a further embodiment of the dishwasher, the damping means is also configured to seal the washing chamber.

This embodiment is particularly advantageous if the automatic metering device is arranged on an interior wall of the dishwasher cavity and is fixed thereto. The automatic metering device is fastened to the interior wall by means of screws, for example. Because the washing chamber is preferably fluid-tight for operating the dishwasher, the openings in the interior wall into which the screws engage are preferably sealed. By the damping means having a sealing effect, it is possible to dispense with an additional seal or the like. As a result, complexity is kept low and costs can be saved. The damping means thus fulfills a dual function, being configured on the one hand to damp the mechanical vibrations of the automatic metering device and on the other hand to seal the dishwasher cavity.

According to a further embodiment of the dishwasher, the damping means is arranged along each vibration transmission path from the automatic metering device to a fastening element of the dishwasher to which the automatic metering device is fastened.

One can also say that the damping means is contained in each transmission path of mechanical vibrations, except for airborne noise. As a result, each mechanical vibration emanating from the automatic metering device is transmitted only in damped form. Here the damping means has specific damping properties. This is understood to mean that the damping means is embodied specifically to damp mechanical vibrations. This can be achieved for example by a suitable choice of material for the damping means and/or a suitable geometric embodiment of the damping means. In particular, there is therefore no mechanical connection between the automatic metering device and the dishwasher along which the mechanical vibrations can propagate in undamped form.

According to a further embodiment of the dishwasher, the automatic metering device comprises a damping unit for the active damping of mechanical vibrations.

The damping unit is embodied in particular to generate a mechanical counter-vibration acting against a mechanical excitation vibration of a component of the metering device when external energy is supplied, and to transmit said counter-vibration to the component. For example, the counter-vibration has an amplitude amounting to between 50% and 100% of the amplitude of the excitation vibration and has a relative phase offset in relation to the excitation vibration of 160°-200°, preferably of 170-190°, more preferably of 175-185°.

By means of this damping unit, a mechanical vibration of the automatic metering device can be reduced overall, even before a transmission takes place by means of a bracket or fastening of the automatic metering device.

According to a further embodiment of the dishwasher, the automatic metering device is configured for metering pourable cleaning agent and/or cleaning agent molded bodies. Cleaning agent molded bodies can likewise be pourable.

Pourable cleaning agent is provided in particular as a powder. Here the powder comprises in particular particle sizes of up to 1 mm. The pourable cleaning agent can also be provided in the form of pellets or tablets, which have for example particle sizes of 1-5 mm. On account of abrasion, particles with a size of less than 1 mm can also be contained in a pouring of pellets or tablets. Cleaning agent molded bodies have in particular a certain geometric shape, for example spherical or cylindrical, wherein the dimensions of any two molded bodies are substantially identical.

According to a further embodiment of the dishwasher, the automatic metering device comprises a receiving unit for receiving a removable storage container for storing the cleaning agent.

The storage container can be removed for example in order to fill the same with cleaning agent. Alternatively or in addition, it can be provided that the storage container is produced by a manufacturer in the form of a prefilled cartridge so that, in order to replenish the supply of cleaning agent, a user must simply remove the empty storage container or the empty cartridge and insert the refilled storage container or the new cartridge.

According to a further embodiment of the dishwasher, the receiving unit and/or the storage container is arranged rotatably in the receiving unit.

In this embodiment, the storage container can be rotated either directly or by means of the receiving unit. For example, the rotation of the storage container can be used to remix and/or loosen up the cleaning agent in the storage container. In particular if the cleaning agent is present in the form of pellets or tablets, it can occur here that mechanical vibrations and/or noises are generated if the pellets or tablet collide with a wall of the storage container. Because the automatic metering device is held in a vibration-insulated manner, these vibrations or noises are not transmitted or are transmitted only in attenuated form to the dishwasher.

According to a further embodiment of the dishwasher, a drive means is provided for rotating the receiving unit and/or the storage container.

The drive means comprises in particular a motor, such as an electric motor. Furthermore, a gear unit, belts, shafts and the like can be provided in order to transmit a force or torque generated by the motor to the receiving unit or the storage container. Because the automatic metering device is held in a vibration-insulated manner, vibrations generated by a motor are not transmitted or are transmitted only in attenuated form to the dishwasher.

In particular, the rotation of the storage container effects a pre-metering of the metering quantity. A pre-metering is understood in particular to mean a separation of the metering quantity from the stored quantity. This can be achieved for example by means of an extraction channel, which is arranged in the interior on an edge of the storage container. By the storage container being rotated, a metering chamber is initially filled with cleaning agent, for example. Here the metering chamber comprises in particular a metering quantity. As a result of continued rotation, the metering quantity is guided along the extraction channel to a dispensing opening under the influence of gravity. From the dispensing opening, the metering quantity can then be dispensed directly or indirectly, for example via the interposition of the metering channel, into the washing chamber.

According to a further embodiment of the dishwasher, the automatic metering device comprises a housing.

The housing is in particular fluid-tight, so that all parts of the automatic metering device arranged in the housing are protected against water and moisture from the washing chamber.

According to a further embodiment of the dishwasher, the housing comprises an airborne noise reducing means.

The airborne noise reducing means can be configured for example to absorb airborne noise and/or to reflect airborne noise. The means can comprise a fleece fabric or similar textiles and/or foamed materials, for example. These materials are configured in particular to absorb airborne noise. Furthermore, the means can comprise a comparatively heavy and plastically deformable material, such as for example bitumen, preferably filled polymer modified bitumen. These materials are configured in particular to reflect airborne noise.

According to a further embodiment of the dishwasher, the housing has a closure flap for extracting and inserting the storage container therein.

The closure flap is configured in particular to close the housing in a fluid-tight manner. To this end, a seal can be provided between the flap and the housing. The closure flap advantageously has the airborne noise reducing means.

According to a further embodiment of the dishwasher, the automatic metering device has a first shell with a first flange and a second shell with a second flange. The automatic metering device is arranged on a through opening of an interior wall of the dishwasher cavity delimiting the washing chamber. The first flange and the second flange rest on the edge of the interior wall delimiting the through opening from opposite sides of the interior wall by way of the damping means. The first shell and the second shell are clamped to one another by way of an internally disposed clamping means.

In particular, the damping means in this embodiment is embodied as a sealing damping means, so that the through opening is sealed in a fluid-tight manner. By way of the internally disposed clamping means, a contact force of the flange onto the damping means is provided in order to fix the automatic metering device and ensure fluid-tightness. The first and the second shell can in particular embody a two-part housing for the automatic metering device. Advantageously, no further fastening means for fastening the automatic metering device in the dishwasher are required in this embodiment.

In embodiments, a mounting ring can also be provided instead of a shell with a circumferential flange.

Furthermore, an additional damping means can be provided between the respective flange and the respective shell in order to strengthen a damping and insulation effect.

According to a further embodiment of the dishwasher, the automatic metering device is arranged on a door of the dishwasher.

The door has in particular a structure with an exterior wall or exterior shell and an interior wall or interior shell. The automatic metering device can be arranged in the intermediate space between the interior wall and the exterior wall, and can be fastened both on the exterior wall and on the interior wall. Alternatively or in addition, the automatic metering device can protrude into the washing chamber.

Further possible implementations of the invention also comprise combinations—not explicitly cited—of features or embodiments described above or below in respect of the exemplary embodiments. In this context, the person skilled in the art will also add individual aspects as improvements or enhancements to the respective basic form of the invention.

BRIEF DESCRIPTION OF THE DRAWINGS

Further advantageous embodiments and aspects of the invention form the subject matter of the subclaims and of the exemplary embodiments of the invention that are described below. The invention is described below in greater detail on the basis of preferred embodiments with reference to the attached figures.

DETAILED DESCRIPTION OF EXEMPLARY EMBODIMENTS OF THE PRESENT INVENTION

Figure 1:
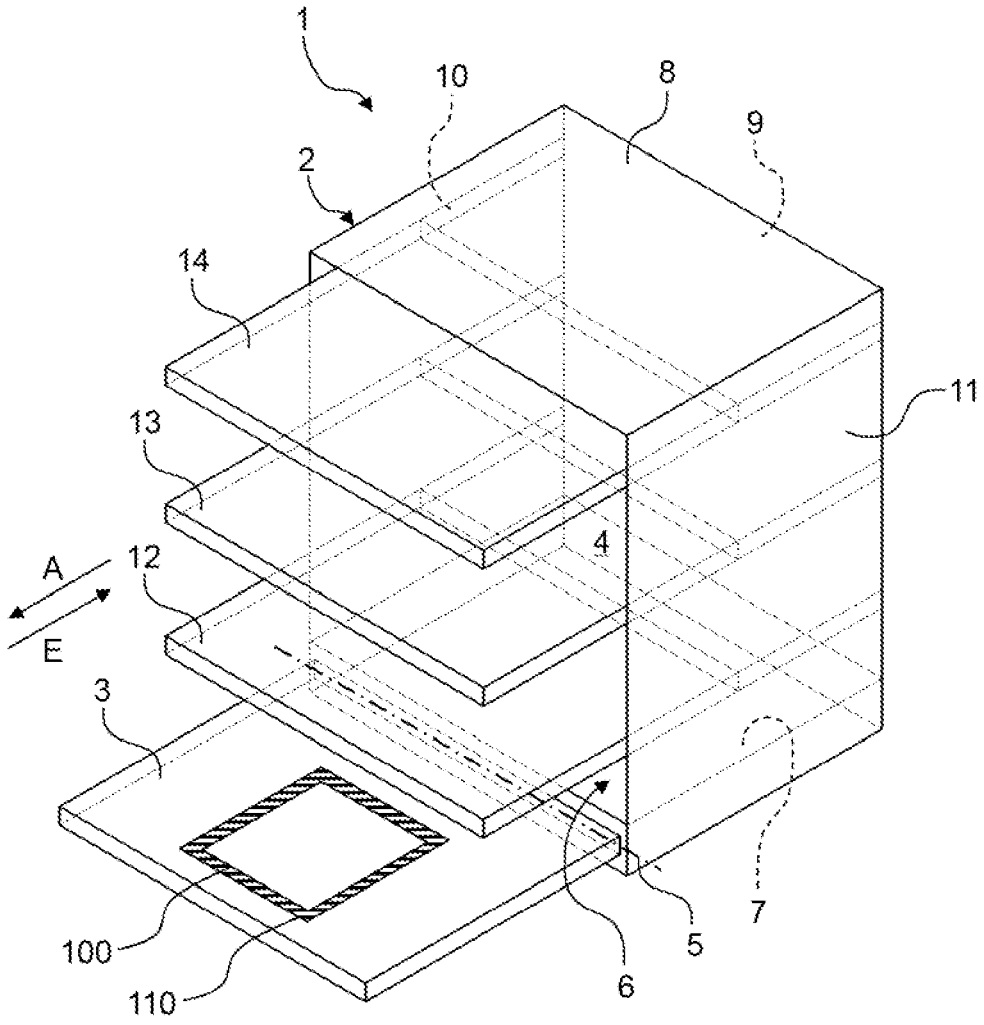
FIG. 1 shows a schematic perspective view of an embodiment of a household dishwasher.

In the figures, elements that are identical or have the same function are provided with the same reference characters unless otherwise stated.

FIG. 1 shows a schematic perspective view of an embodiment of a dishwasher 1, which is embodied here as a household dishwasher. The household dishwasher 1 has a dishwasher cavity 2, which can be closed by a door 3, in particular in a watertight manner. A sealing facility can be provided for this purpose between the door 3 and the dishwasher cavity 2. The dishwasher cavity 2 is preferably cuboid in shape. The dishwasher cavity 2 may be arranged in a housing of the household dishwasher 1. The dishwasher cavity 2 and the door 3 may form a washing chamber 4 for washing items to be washed.

The door 3 is shown in its opened position in FIG. 1. The door 3 can be closed or opened by pivoting about a pivot axis 5 provided on a lower end of the door 3. A loading opening 6 of the dishwasher cavity 2 can be closed or opened with the aid of the door 3. The dishwasher cavity 2 has a bottom 7, a ceiling 8 arranged opposite the bottom 7, a rear wall 9 arranged opposite the closed door 3 and two side walls 10, 11 arranged opposite one another. The bottom 7, the ceiling 8, the rear wall 9 and the side walls 10, 11 may be manufactured from a stainless steel sheet for example. Alternatively, the bottom 7 may be manufactured from a plastic material.

Furthermore, the household dishwasher 1 has at least one receptacle for items to be washed 12 to 14. A number of, for instance three, receptacles for items to be washed 12 to 14 can preferably be provided, wherein the receptacle for items to be washed 12 can be a lower receptacle for items to be washed or a bottom basket, the receptacle for items to be washed 13 can be an upper receptacle for items to be washed or an upper basket and the receptacle for items to be washed 14 can be a cutlery drawer. As additionally shown in FIG. 1, the receptacles for items to be washed 12 to 14 are arranged one above the other in the dishwasher cavity 2. Each receptacle for items to be washed 12 to 14 is optionally able to be shifted into or out of the dishwasher cavity 2. In particular, each receptacle for items to be washed 12 to 14 is able to be inserted or pushed into the dishwasher cavity 2 in an insertion direction E and extracted or pulled out from the dishwasher cavity 2 in an extraction direction A opposite to the insertion direction E.

Furthermore, an automatic metering device 100 is arranged on the interior side of the door 3. The automatic metering device 100 is held in a vibration-insulated manner by a vibration-insulating bracket 110. The automatic metering device 100 comprises in particular movable or also drive components (not shown), which can be considered as exciters in terms of mechanical vibrations. On account of the vibration-insulated bracket 110, mechanical vibrations generated by such an exciter are not transmitted or are transmitted only in attenuated form to the door 3. This is explained in more detail in a chart in FIG. 2.

Figure 2:
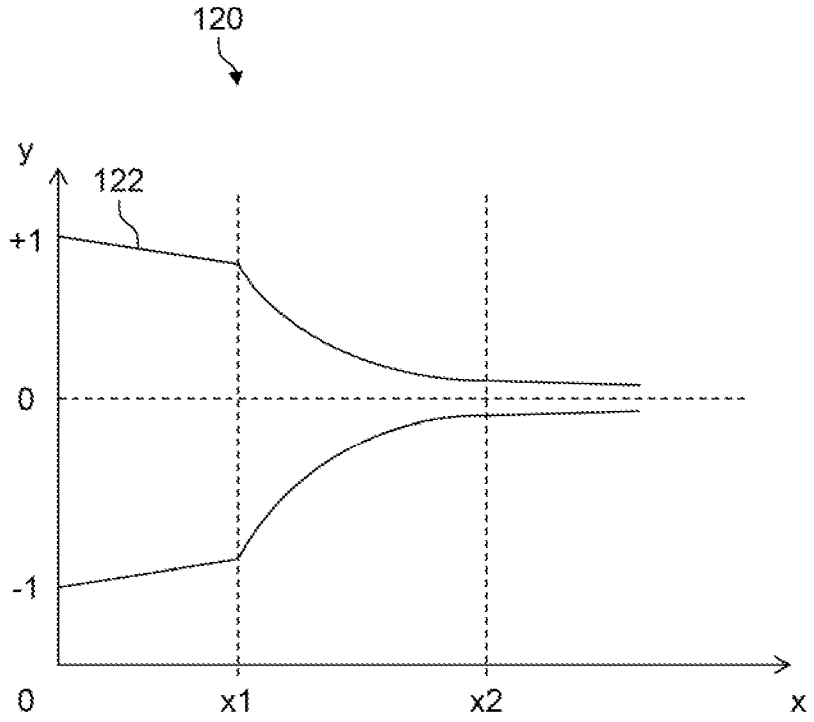
FIG. 2 shows an exemplary chart of a transmission of a mechanical vibration.

FIG. 2 shows an exemplary chart 120 of a damped transmission of a mechanical vibration, for example from the automatic metering system 100 to the door 3, as shown in FIG. 1. The y-axis of the chart 120 shows a vibration amplitude of a vibration with a certain frequency. The x-axis shows a distance from the exciter generating the vibration, for example an electric motor of the automatic metering device 100. For reasons of clarity, the envelope 122 of the vibration is shown in the chart 120. In the chart 120, the vibration amplitude is standardized to the value 1, which is achieved in the exciter when x=0.

Two positions are marked on the x-axis. The damping means 110 begins at x=x1, for example. The damping means ends at x=x2.

The exciter is located at x=0, for example. Starting from the exciter, the vibration propagates for example via a housing of the automatic metering device 100 to a vibration-insulating bracket 110 (see FIG. 1), with which the automatic metering device 100 is fastened. The vibration initially also propagates along the vibration-insulating bracket 110 and in so doing is attenuated only very slightly, as up to that point it has not passed through any damping means 112 (see FIG. 3). The damping means 112, which is embodied for example as an elastomer, begins at the position x=x1. Because the damping means 112 has good damping properties, the amplitude of the vibration drops exponentially to a value of approximately 10% of the initial amplitude over a short distance, for example 1 cm. The damping means 112 ends at the position x=x2. Depending on the embodiment of the vibration-insulating bracket 110, the damping means 112 is fastened directly to a further component of the household dishwasher 1, or there follows a further section of the vibration-insulating bracket 110.

As distinct from the representation, further damping means and/or additional damping sections can be provided in the vibration-insulating bracket 110. In particular, different damping means 112 optimized for different frequency ranges can be provided, wherein vibrations advantageously pass through different damping means 112 along each transmission path from the automatic metering device 100 to the dishwasher 1 so that the entire relevant frequency range is covered.

Figure 3:
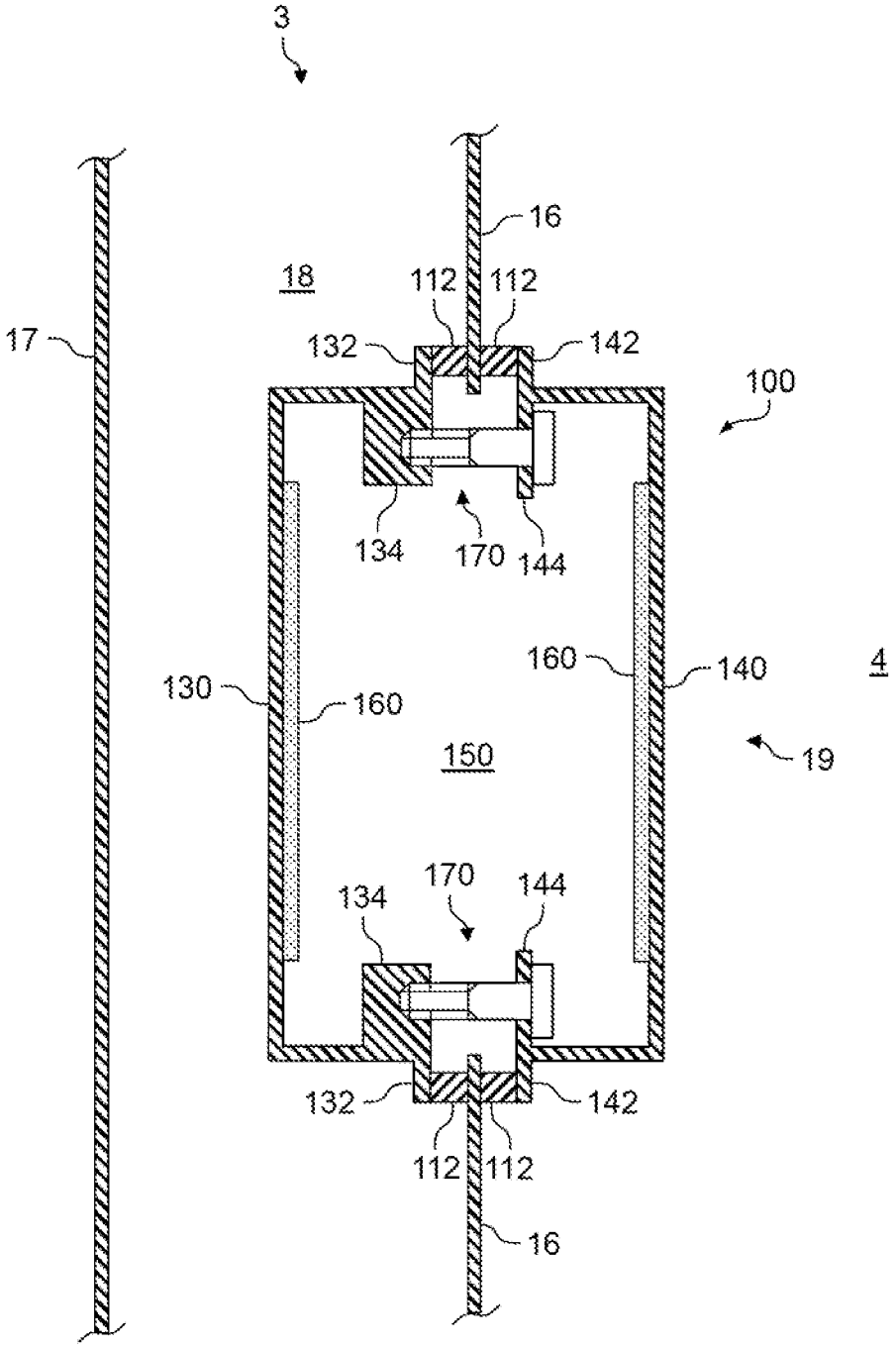
FIG. 3 shows a schematic exemplary embodiment of an automatic metering device held in a vibration-insulated manner.

FIG. 3 shows a schematic exemplary embodiment of a metering device 100 held in a vibration-insulated manner, which can be used for example with the household dishwasher 1. In the example of FIG. 3, the automatic metering device 100 is inserted into a through opening 19 in an interior wall 16 of the door 3. The door 3 is shown here in a section from the side. The door 3 is delimited toward the outside by an exterior wall 17.

In the example of FIG. 3, the automatic metering device 100 comprises a housing which consists of a first shell 130 and a second shell 140 and in particular provides a fluid-tight interior 150 for the further components of the automatic metering device 100. The first shell 130 is arranged in the intermediate space 18 between the exterior wall 17 and the interior wall 16 of the door 3 and rests with a circumferential flange 132 by way of a damping means 112 on an edge of the interior wall 16 delimiting the through opening 19. The second shell 140 projects into the washing chamber 4 and rests with a circumferential flange 142 by way of a damping means 112 on an edge of the interior wall 16 delimiting the through opening 19. The first shell 130 and the second shell 140 thus rest in each case by way of a damping means 112 on the interior wall 16 from opposite sides. The damping means 112 is embodied in particular as a combined sealing damping means. The damping means 112 is embodied for example in the shape of a circumferential ring. Furthermore, an airborne noise reducing means 160 is arranged in each case on the first shell 130 and on the second shell 140, which means here comprises a fleece fabric on the front side for absorbing airborne noise and a bitumen layer on the rear side for reflecting airborne noise.

The first shell 130 also has an internally disposed receptacle 134 for a clamping means 170. This receptacle is embodied here as a thread 134 in the first shell 130. The second shell 140 has a likewise internally disposed receptacle 134 for the clamping means 170, which receptacle functions as an abutment. For example, the clamping means 170 is embodied as a screw and the receptacle 144 is embodied as a bush for the screw 170. For the reciprocal clamping of the first shell 130 with the second shell 140, the screw 170 is for example guided through the bush 144 in the second shell 140 and screwed into the thread 134 in the first shell 130. As a result, the first shell 130 and the second shell 140 are pulled toward one another so that a contact pressure is applied by way of the flange 132, 142 onto the damping means 112 and the edge of the interior wall 16. This contact pressure on the one hand holds the automatic metering system 100 in place and on the other hand ensures that the damping means 112 seals the interior 150 of the automatic metering device 100 in a fluid-tight manner.

Further components of the automatic metering device 100, such as for example a receiving unit for receiving a supply container, an extraction unit for extracting the metering quantity from the supply of cleaning agent, an active damping unit, a drive means and where appropriate a metering channel and the like are not shown in FIG. 3 for reasons of clarity. It can also be provided that the automatic metering device 100 has components which are not arranged in the fluid-tight interior 150.

Although the present invention has been described with reference to exemplary embodiments, it can be modified in numerous different ways.

The invention claimed is:

1. A dishwasher, comprising:

a washing chamber; and an automatic metering device configured to automatically meter a plurality of metering quantities from a supply of cleaning agent in the form of a solid material into the washing chamber, said automatic metering device being held in a vibration-insulated manner by a damping means and comprising:

a first shell with a first flange; and a second shell with a second flange, wherein the automatic metering device is arranged on a through opening of an interior wall of a dishwasher cavity delimiting the washing chamber, wherein the first flange and the second flange rest on the edge of the interior wall delimiting the through opening from opposite sides of the interior wall by way of the damping means, and wherein the first shell and the second shell are clamped to one another by an internally disposed clamping means.

2. The dishwasher of claim 1, constructed in the form of a household dishwasher.

3. The dishwasher of claim 1, wherein the damping means is configured to seal the washing chamber.

4. The dishwasher of claim 1, further comprising a fastening element fastening the automatic metering device to the dishwasher, said damping means being arranged along each vibration transmission path from the automatic metering device to the fastening element.

5. The dishwasher of claim 1, wherein the damping means comprises a damping unit for active damping of a mechanical vibration.

6. The dishwasher of claim 1, wherein the automatic metering device is configured for metering pourable cleaning agent and/or cleaning agent molded bodies.

7. The dishwasher of claim 1, wherein the automatic metering device includes a receiving unit for receiving a removable storage container for storing the cleaning agent.

8. The dishwasher of claim 7, wherein at least one member selected from the group consisting of the receiving unit and the storage container in the receiving unit is mounted for rotation.

9. The dishwasher of claim 8, further comprising a drive means for rotating the member.

10. The dishwasher of claim 1, wherein the automatic metering device includes a housing.

11. The dishwasher of claim 10, wherein the housing comprises an airborne noise reducing means.

12. The dishwasher of claim 10, wherein the housing includes a closure flap for extracting a storage container from the housing and inserting the storage container in the housing.

13. The dishwasher of claim 1, further comprising a door, said automatic metering device being arranged on the door.

* * * * *